US009856423B2

(12) United States Patent
Hao et al.

(10) Patent No.: US 9,856,423 B2
(45) Date of Patent: Jan. 2, 2018

(54) PROCESS FOR DEEPLY DESULFURIZING CATALYTIC CRACKING GASOLINE

(71) Applicants: Tianzhen Hao, Cangzhou (CN); CHINA UNIVERSITY OF PETROLEUM—BEIJING, Beijing (CN)

(72) Inventors: Tianzhen Hao, Cangzhou (CN); Jinsen Gao, Beijing (CN); Dezhong Li, Cangzhou (CN); Liang Zhao, Beijing (CN); Zhiyuan Lu, Cangzhou (CN); Xingying Lan, Beijing (CN)

(73) Assignees: Tianzhen Hao, Hebei (CN); CHINA UNIVERSITY OF PETROLEUM-BEIJING, Beijing (CN)

( * ) Notice: Subject to any disclaimer, the term of this patent is extended or adjusted under 35 U.S.C. 154(b) by 244 days.

(21) Appl. No.: 14/684,196

(22) Filed: Apr. 10, 2015

(65) Prior Publication Data

US 2015/0210941 A1 Jul. 30, 2015

Related U.S. Application Data

(63) Continuation of application No. PCT/CN2014/070817, filed on Jan. 17, 2014.

(30) Foreign Application Priority Data

Nov. 18, 2013 (CN) ..... 2013 1 0581366

(51) Int. Cl.
*C10G 67/04* (2006.01)
*C10G 21/28* (2006.01)
(Continued)

(52) U.S. Cl.
CPC ..... *C10G 67/04* (2013.01); *C10G 21/14* (2013.01); *C10G 21/16* (2013.01); *C10G 21/20* (2013.01);
(Continued)

(58) Field of Classification Search
CPC ..... C10G 21/00; C10G 21/02; C10G 21/12; C10G 21/14; C10G 21/16; C10G 21/20;
(Continued)

(56) References Cited

U.S. PATENT DOCUMENTS 2,886,610 A * 5/1959 Georgian ..... C10G 21/02 203/55
2,970,101 A * 1/1961 Georgian ..... C10G 21/00 208/70

(Continued)

*Primary Examiner* — Randy Boyer
*Assistant Examiner* — Brandi M Doyle
(74) *Attorney, Agent, or Firm* — J.C. Patents

(57) ABSTRACT

The present invention provides a process for desulfurizing gasoline fraction by solvent extraction: introducing the gasoline fraction into an extraction tower at a lower-middle part thereof, introducing a solvent into the extraction tower at the top thereof, injecting saturated C5 hydrocarbon into a reflux device at the bottom of the extraction tower, wherein the gasoline fraction which is desulfurized flows out from the top of the extraction tower; the solvent that has extracted sulfide, aromatics and C5 hydrocarbon flows out from the bottom of the extraction tower, and is separated into a C5 hydrocarbon-containing light component, a sulfur-rich component, water and the solvent. The present invention also provides a process for deeply desulfurizing catalytic cracking gasoline, which flexibly combines the process described above and an existing desulfurization technology.

12 Claims, 4 Drawing Sheets

(51) Int. Cl.

| | |
|---|---|
| ***C10G 21/14*** | (2006.01) |
| ***C10G 21/16*** | (2006.01) |
| ***C10G 21/22*** | (2006.01) |
| ***C10G 21/20*** | (2006.01) |
| ***C10G 53/16*** | (2006.01) |
| ***C10G 67/16*** | (2006.01) |

(52) U.S. Cl.
CPC ..... *C10G 21/22* (2013.01); *C10G 21/28* (2013.01); *C10G 53/16* (2013.01); *C10G 67/16* (2013.01); *C10G 2300/202* (2013.01); *C10G 2400/02* (2013.01)

(58) Field of Classification Search
CPC ..... C10G 21/22; C10G 21/28; C10G 53/04; C10G 53/06; C10G 53/16; C10G 67/04; C10G 67/16; C10G 2300/202; C10G 2400/02
See application file for complete search history.

(56) References Cited

U.S. PATENT DOCUMENTS 5,582,714 A * 12/1996 Forte ..... C10G 21/16 208/227
6,623,627 B1 * 9/2003 Zhou ..... C10G 67/16 208/208 R
7,005,058 B1 * 2/2006 Towler ..... C10G 45/72 208/211

* cited by examiner

PROCESS FOR DEEPLY DESULFURIZING CATALYTIC CRACKING GASOLINE

CROSS-REFERENCE TO RELATED APPLICATIONS

This application is a continuation of International Application No. PCT/CN2014/070817, filed on Jan. 17, 2014, which claims the priority benefit of Chinese Patent Application No. 201310581366.8, filed on Nov. 18, 2013. The contents of the above identified applications are incorporated herein by reference in their entireties.

FIELD OF THE TECHNOLOGY

The present invention relates to a process for desulfurizing gasoline and, in particular, to a process for deeply desulfurizing catalytic cracking gasoline.

BACKGROUND

Confronted with a trend of increasingly severe hazy weather, the government has accelerated the pace of quality upgrading of gasoline and diesel, and state IV emission standard for oil products was nationally implemented in 2014, which requires the sulfur content of gasoline to be decreased to less than 50 ppm; meanwhile state V quality standard was put forward, which requires the sulfur content of gasoline below 10 ppm, and was implemented in Beijing, Shanghai and Guangzhou in 2013 firstly. The catalytic cracking gasoline accounts for a share of about 70~80% of domestic gasoline product components, and thus as a matter of fact, gasoline desulfurization mainly refers to catalytic cracking gasoline desulfurization.

Existing representative technology for desulfurizing catalytic cracking gasoline includes Chinese Sinopec's S-zorb and Research Institute of Petroleum Processing's RSDS and French Prime-G+. The S-zorb is initially developed by U.S. Conocophillips company, and is bought out and improved by China Sinopec Corporation. The S-zorb is used for desulfurizing full-range catalytic gasoline, and after desulfurizing, sulfur content may be controlled below 10 ppm and octane number loss of the full-range gasoline is 1.0~2.0 units. The RSDS is developed by Research Institute of Petroleum Processing, this technology separates the catalytic gasoline into light and heavy fractions firstly, wherein the light fractions are sweetened by extraction, and the heavy fractions are subjected to selective hydrodesulfurization; when a product having sulfur content of less than 10 ppm is produced by this technology, the yield of light fractions is about 20%, a majority thereof needs to be hydrogenated, and the octane number loss of the full-range gasoline is between 3.0~40. The Prime-G+ is developed by French Axens company, it uses a process flow of full-range prehydrogenation, light and heavy gasoline separation, and heavy fraction selective hydrodesulfurization, and is characterized in that: during the full-range prehydrogenation, light sulfide is reacted with dialkene to form a sulfide with a high boiling point, wherein the olefin is not being saturated, and then light and heavy gasoline fractions are separated into a light fraction having a sulfur content of less than 10 ppm and a sulfur-rich heavy fraction, with the heavy fraction subjected to hydrodesulfurization; as in the RSDS, although a part of sulfur-poor light components may not be subjected to a hydrogenation treatment, since the yield of the light components with sulfur content of less than 10 ppm is very low, a majority thereof needs the hydrogenation treatment, resulting in that the octane number loss of the full-range gasoline also is between 3.0~4.0.

In summary, there are many problems, such as a large proportion of hydrogenation treatment in the whole process and high octane number loss, in these existing technologies for reducing sulfur content of catalytic cracking gasoline, when they are used for deep desulfurization of gasoline. There is a pressing need in the market to develop a non-hydrodesulfurization technology with low octane number loss.

SUMMARY

After years of study, inventors of the present invention found that the distribution of sulfides in catalytic cracking gasoline has the following characteristics:

1. C5 light fraction (generally, with boiling point <40° C.) mainly contains mercaptan sulfur;
2. C6 fraction (generally, 40~80° C.) mainly contains thiophene sulfur;
3. C7 fraction (generally, 70~110° C.) mainly contains methylthiophene sulfur;
4. The fraction with more than seven carbons mainly contains alkylthiophene sulfur and thioether sulfur.

The mercaptan sulfur in the C5 fraction may be converted into macromolecular sulfide with a high boiling point via an alkali-free sweetening or Prime-G+ prehydrogenation process, and then the sulfide is transferred into a heavy gasoline fraction via distillation; or the mercaptan sulfur in the C5 fraction may be extracted into a pure alkali liquor for removal, such that sulfur content in the C5 fraction may be decreased to below 10 ppm without hydrogenation, and there is no loss in the octane number.

Thiophene in the C6 fraction and methylthiophene in the C7 fraction have characteristics similar to benzene and toluene, and can be extracted from hydrocarbon components by a well established method similar to aromatics extraction. As for the fraction with more than seven carbons, due to increased molecular weight, extraction selectivity of sulfide from hydrocarbons decreases, and also due to a higher boiling point, solvent regeneration requires a higher temperature, which will cause aggravation of vulcanization between sulfide and olefin. Furthermore, the fraction with eight or more carbons has relatively low olefin content, and has low octane number loss during the hydrodesulfurization process, and thus heavy fraction gasoline still employs selective hydrodesulfurization.

Based on the above findings, an object of the present invention is to provide a process for desulfurizing catalytic cracking gasoline, which not only can deeply remove sulfide contained in the catalytic cracking gasoline, but also can reduce the proportion of the hydrodesulfurization in the whole process, and reduce octane number loss of gasoline during a deep desulfurization process.

The object of the present invention as described above is achieved via the following technical solutions:

Firstly, the present invention provides a process for desulfurizing a gasoline fraction by solvent extraction, including steps of:

introducing the gasoline fraction into an extraction tower from a lower-middle part thereof, introducing a solvent into the extraction tower from the top thereof, and at the same time injecting saturated C5 hydrocarbon into a reflux device at the bottom of the extraction tower, where the temperature at the top of the extraction tower is controlled between 55~100° C., the temperature at the bottom of the extraction tower is controlled between 40~80° C., and the pressure (absolute) at the top of the extraction tower is controlled between 0.2~0.7 MPa, a feeding ratio of the solvent to the gasoline fraction is controlled between 1.0~5.0, and a feeding ratio of the saturated C5 hydrocarbon to the gasoline fraction is controlled between 0.1~0.5, and where the gasoline fraction and the solvent are contacted at the upper section of the extraction tower via a multi-stage countercurrent, meanwhile the saturated C5 hydrocarbon and the solvent are contacted fully at the lower section of the extraction tower; the gasoline fraction which is desulfurized by extraction flows out from the top of the extraction tower as a material A, and the solvent that has extracted sulfide, aromatics and the saturated C5 hydrocarbon flows out from the bottom of the extraction tower as a material B; washing the material A with water for removing the solvent therein, to obtain a desulfurized gasoline fraction; further treating the material B to separate therefrom a C5 hydrocarbon-containing light component, a sulfur-rich component (containing sulfide, aromatics and cycloolefin), water and solvent, wherein the C5 hydrocarbon-containing light component is returned to the reflux device of the extraction tower, the water is used as washing water to be returned to the step of washing the material A for removing the solvent therein, and the solvent is returned to the top of the extraction tower.

In a preferred embodiment of the present invention, the gasoline fraction described above is preferably a light gasoline fraction with a boiling point lower than 130° C., more preferably a gasoline fraction with a boiling range of 40~100° C.

Basically, solvents for aromatics extraction are suitable for the desulfurization step in an extraction tower according to the present invention, for instance, diethylene glycol, triethylene glycol, tetraethylene glycol, dimethyl sulfoxide, sulfolane, N-formyl morpholine, N-methyl pyrrolidone, polyethylene glycol, or propylene carbonate, or a mixed solvent mainly containing one or two of these components; a preferred solvent for the extraction according to the present invention is tetraethylene glycol or sulfolane.

The water content of the solvent is preferably less than 1.0% by weight, and more preferably 0.6~0.8% by weight.

In embodiments of the present invention, the temperature at the top of the extraction tower is preferably controlled between 65~80° C., the temperature at the bottom of the extraction tower is preferably controlled between 50~60° C., the pressure (absolute) at the top of the extraction tower is preferably controlled between 0.5~0.6 MPa, a feeding ratio of the solvent to the gasoline fraction is preferably controlled between 2.0~3.0, and a feeding ratio of the saturated C5 hydrocarbon to the gasoline fraction is preferably controlled between 0.2~0.3.

In an embodiment of the present invention, the amount of the water for washing the material A (relative to material A product) is 1.0~40.0%; preferably 2~4%.

In a further preferred embodiment of the present invention, the material B is further treated, which specifically includes the following steps:

① introducing the material B into an extraction distillation tower at the top thereof, where the pressure (absolute) of the extraction distillation tower is controlled between 0.15~0.3 MPa, and the temperature at the bottom of the extraction distillation tower is controlled between 150~180° C., a C5 hydrocarbon-containing light component is distilled out, as material C, at the top of the extraction distillation tower, and a sulfur-rich solvent is obtained as material D at the bottom of the extraction distillation tower;

② after being condensed, returning the material C obtained from step ① to the reflux device at the bottom of the extraction tower of the present invention; introducing the material D into a recycling tower from the middle part thereof, where the pressure (absolute) of the recycling tower is controlled between 0.015~0.05 MPa, and the temperature at the bottom of the recycling tower is controlled between 130~180° C.; a material E, i.e., a sulfur-rich oil containing sulfide, aromatics and cycloolefin, is obtained at the top of the recycling tower; a material F with solvent as its main component is obtained at the bottom of the recycling tower; and ③ condensing the material E obtained from step ② and conducting a water oil separation on the condensed material E to obtain water and a sulfur-rich component G; returning a portion of the separated water to the top of the recycling tower in step ②, and returning the rest as washing water to the step of washing the material A for removing the solvent therein; returning the material F obtained from step ②, after heat-exchange, to the top of the extraction tower for recycling.

In a further preferred embodiment of the present invention: in step ①, the pressure of the extraction distillation tower is preferably controlled at 0.2 MPa, and the temperature at the bottom of the extraction distillation tower is preferably controlled at 160° C.; in step ②, the pressure of the recycling tower is preferably controlled between 0.035~0.045 MPa, and the temperature at the bottom of the recycling tower is preferably controlled between 165~175° C.

The process for desulfurizing a gasoline fraction by solvent extraction according to the present invention is widely applicable in the production practice, and may be flexibly combined into different deep desulfurization processes according to an existing desulfurization technology of an enterprise.

Various equipments used in the process for desulfurizing a gasoline fraction by solvent extraction according to the present invention are basically the same as existing aromatics extraction equipments of reformed gasoline C6~C7 fractions.

Based on the process for desulfurizing a gasoline fraction by solvent extraction described above, the present invention further provides a process for deeply desulfurizing a catalytic cracking gasoline, including steps of:

1) separating the catalytic cracking gasoline into a light gasoline fraction, a medium gasoline fraction and a heavy gasoline fraction, where the light gasoline fraction and the medium gasoline fraction are separated at a cutting point of 35~50° C., the medium gasoline fraction and the heavy gasoline fraction are separated at a cutting point of 70~130° C.;

2) conducting a mercaptan removal treatment on the light gasoline fraction obtained from step 1), to obtain a desulfurized light fraction having a sulfur content of less than 10 ppm and a sulfur-rich component H;

3) treating the medium gasoline fraction obtained from step 1) according to the process for desulfurizing a gasoline fraction by solvent extraction of the present invention as described above, to obtain a desulfurized medium fraction having a sulfur content of less than 10 ppm and a sulfur-rich component G; and 4) conducting a desulfurization treatment on the heavy gasoline fraction obtained from step 1), the sulfur-rich component H obtained from step 2), and the sulfur-rich component G obtained from step 3) together by using a selective hydrodesulfurization process, to obtain a desulfurized heavy fraction having a sulfur content of less than 10 ppm.

Preferably, before the separation of the catalytic cracking gasoline in step 1), micromolecular mercaptan in the catalytic cracking gasoline is converted into macromolecular sulfide with a high boiling point via an alkali-free sweetening or Prime-G+ prehydrogenation process.

The light gasoline fraction obtained in step 2) is preferably introduced into the reflux device of the extraction tower used in the desulfurization process by extraction in step 3).

The mercaptan removal treatment in the step 2) may use any mercaptan removal process achievable in the prior art, for instance, the mercaptan sulfur in a C5 fraction can be removed by extracting it into a pure alkali liquor.

The selective hydrodesulfurization process in the step 4) may be any selective hydrodesulfurization process available in the prior art, such as S-zorb, RSDS, OCT-M, Prime-G+, CODS, etc.

Based on the process for desulfurizing a gasoline fraction by solvent extraction described above, the present invention further provides another process for deeply desulfurizing catalytic cracking gasoline, including steps of:

i) separating the catalytic cracking gasoline into a light gasoline fraction I and a heavy gasoline fraction I at a cutting point of 50~130° C.;

ii) treating the light gasoline fraction I obtained in step i) according to the process for desulfurizing a gasoline fraction by solvent extraction of the present invention as described above, to obtain a desulfurized light fraction I having a sulfur content of less than 10 ppm and a sulfur-rich component J; and iii) conducting a desulfurization treatment on the heavy gasoline fraction I obtained in step i) together with the sulfur-rich component J obtained in step ii) by using a selective hydrodesulfurization process, to obtain a desulfurized heavy fraction I having a sulfur content of less than 10 ppm.

In the process above, in step ii), the light gasoline fraction I obtained in step i) may be subjected to a mercaptan removal treatment firstly, and then the resulting mercaptan-removed light gasoline fraction I' is finely separated into a light gasoline fraction II and a medium gasoline fraction I at a cutting point of 35~50° C., and then the medium gasoline fraction I is subjected to the desulfurization treatment according to the process for desulfurizing a gasoline fraction by solvent extraction as described in in the present invention to obtain a desulfurized medium fraction I having a sulfur content of less than 10 ppm and a sulfur-rich component K; and the sulfur-rich component K instead of the sulfur-rich component J is introduced into the step iii) to be desulfurized together with the heavy gasoline fraction.

In the process above: in step ii), the light gasoline fraction I obtained in step i) may also be subjected to a mercaptan removal treatment by extraction firstly to obtain a mercaptan-removed light gasoline fraction I' and a sulfur-rich component L, and then the mercaptan-removed light gasoline fraction I' is subjected to the desulfurizing treatment by solvent extraction as described in the present invention to obtain a desulfurized light fraction II having a sulfur content of less than 10 ppm and a sulfur-rich component M; and the sulfur-rich component L and the sulfur-rich component M, instead of the sulfur-rich component J, are introduced into the step iii) to be desulfurized together with the heavy gasoline fraction.

Based on the process for desulfurizing a gasoline fraction by solvent extraction described above, the present invention further provides still another process for deeply desulfurizing catalytic cracking gasoline, including steps of:

I) treating full-range catalytic cracking gasoline according to the process for desulfurizing a gasoline fraction by solvent extraction as described in the present invention to obtain a desulfurized component and a sulfur-rich component N; and II) conducting a selective hydrodesulfurization treatment on the sulfur-rich component N obtained in step I), to obtain a desulfurized component having a sulfur content of less than 10 ppm.

Compared with the prior art, the process for deeply desulfurizing catalytic cracking gasoline according to the present invention can achieve deep desulfurization (enabling the sulfur content of the treated gasoline fractions to decrease to less than 10 ppm, even less than 5 ppm), and more importantly, octane number loss of the catalytic cracking gasoline is reduced significantly during the treatment.

The present invention uses saturated C5 hydrocarbon as a reflux in extraction desulfurization. In the lower section of the extraction tower, the saturated C5 hydrocarbon displaces as much as possible olefin that has been dissolved in the solvent during the desulfurization in the upper section, so that when a rich solvent leaves the extraction tower, only sulfide, aromatics, cycloolefin and the saturated C5 hydrocarbon, all of which have a larger dissolubility in the solvent, remain in the solvent, where the saturated C5 hydrocarbon is recovered via extraction distillation, and returned to the extraction tower for recycling, and the sulfide, the aromatics, and the cycloolefin are main components of the sulfur-rich oil. When the sulfur-rich oil is hydrogenated, the sulfide is decomposed and removed, the aromatics are not involved in the reaction, and when the cycloolefine is saturated by hydrogenation, octane number will increase to some extent, and thus when the sulfur-rich oil is hydrodesulfurized, there will be no any octane number loss, that is to say, the process for desulfurizing a gasoline fraction by solvent extraction of the present invention does not bring octane number loss.

Heavy fraction (typically having a boiling point higher than 100° C.) contains aromatics with seven carbons, cycloalkanes, cycloolefins and hydrocarbons with eight or more carbons. The total yield of the heavy fraction is about 40% by weight of full-fraction gasoline, and the olefin content of the heavy fraction accounts for about 16% by weight. When sulfur is decreased to less than 10 ppm by using an existing hydrodesulfurization technology, olefin saturation ratio of the heavy fraction is generally less than 30%, and the octane number loss in the hydrodesulfurization for the heavy fraction is about 0.5 units.

According to the process for deeply desulfurizing a catalytic cracking gasoline of the present invention, sulfur content of the catalytic gasoline can be decreased to less than 10 ppm, and octane number loss of the full-range gasoline is within 0.2, which is far better than the index of 1.0 units of the currently most advanced S-zorb technology, and reaches the world leading level.

Figure 1:
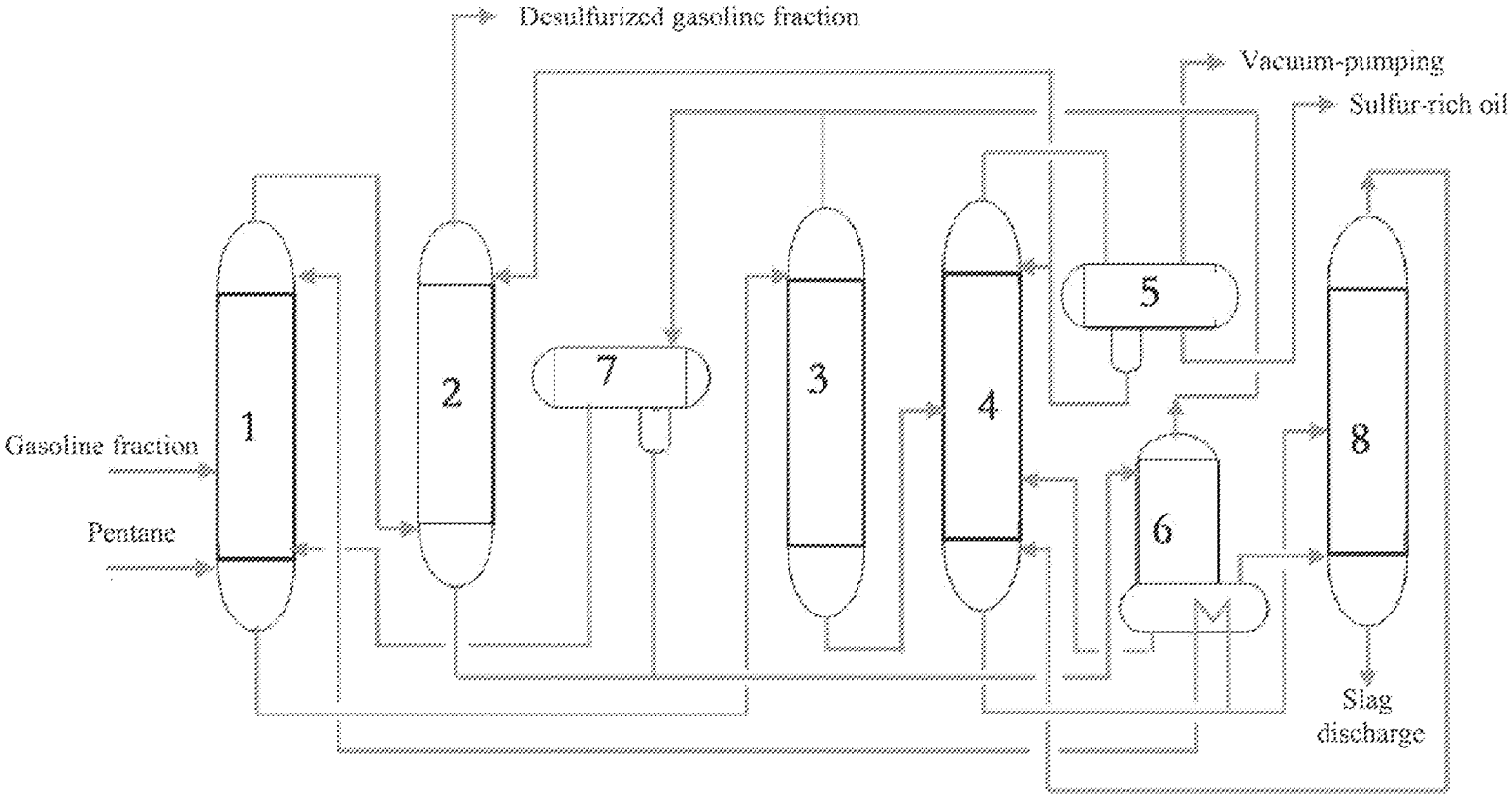
FIG. 1 is a process flow chart of a process for desulfurizing a gasoline fraction by solvent extraction according to the present invention.

Reference numerals in FIG. 1 are illustrated as follows: 1. extraction tower; 2. washing tower; 3. extraction distillation tower; 4. recycling tower; 5. sulfur-rich oil tank; 6. water fractionation tower; 7. reflux accumulator; 8. solvent regeneration tower.

Figure 2:
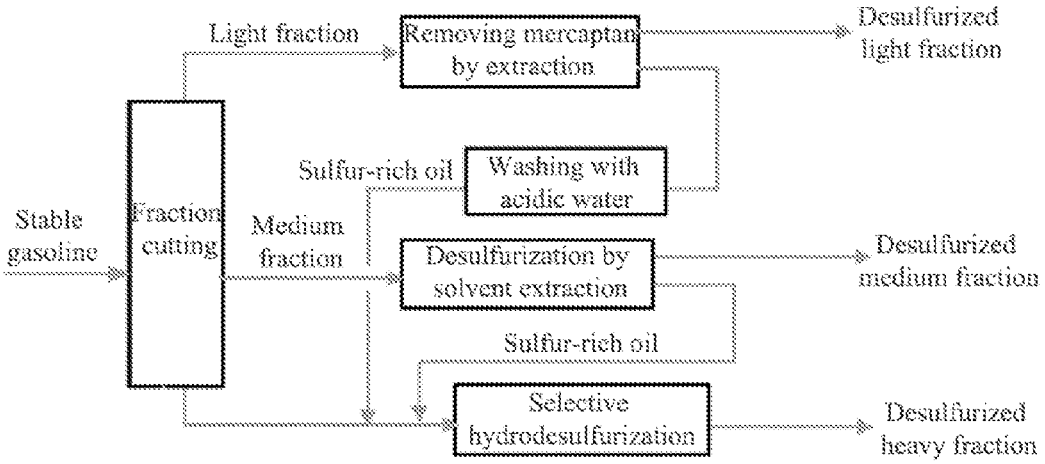

FIG. 2 is a process flow chart of a process for deeply desulfurizing catalytic cracking gasoline according to Embodiment 3 of the present invention.

Figure 3:
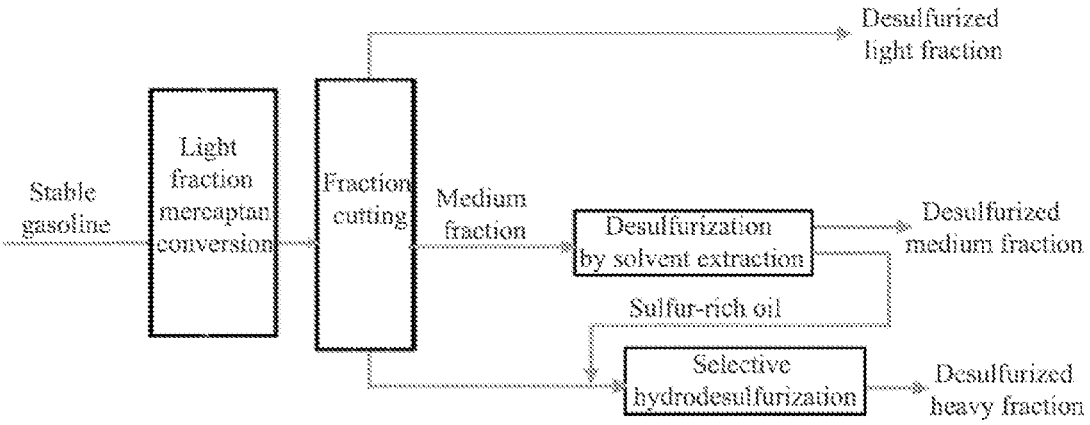

FIG. 3 is a process flow chart of a process for deeply desulfurizing catalytic cracking gasoline according to Embodiment 4 of the present invention.

Figure 4:
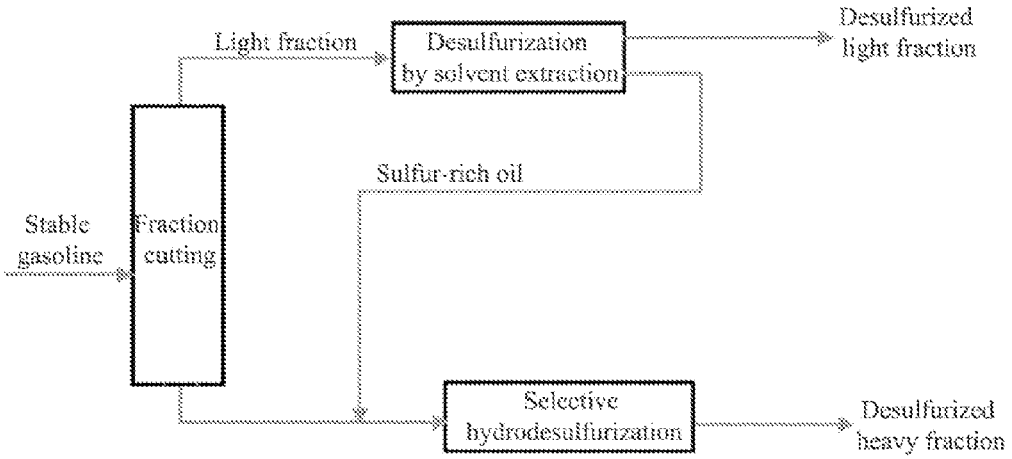

FIG. 4 is a process flow chart of a process for deeply desulfurizing catalytic cracking gasoline according to Embodiment 5 of the present invention.

Figure 5:
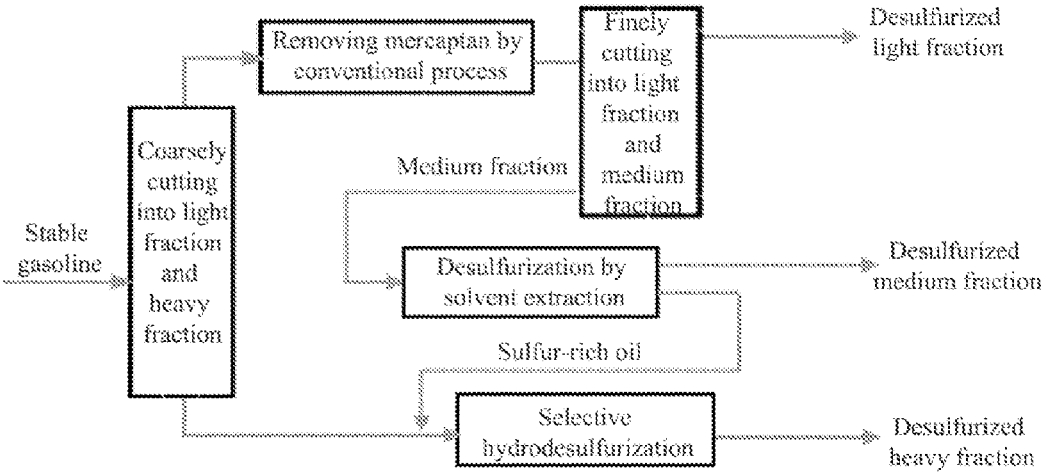

FIG. 5 is a process flow chart of a process for deeply desulfurizing catalytic cracking gasoline according to Embodiment 6 of the present invention.

Figure 6:
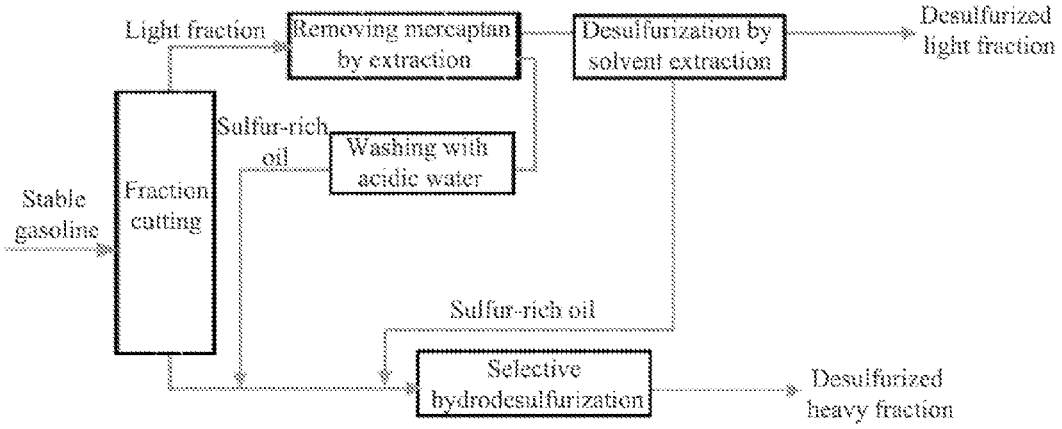

FIG. 6 is a process flow chart of a process for deeply desulfurizing catalytic cracking gasoline according to Embodiment 7 of the present invention.

Figure 7:
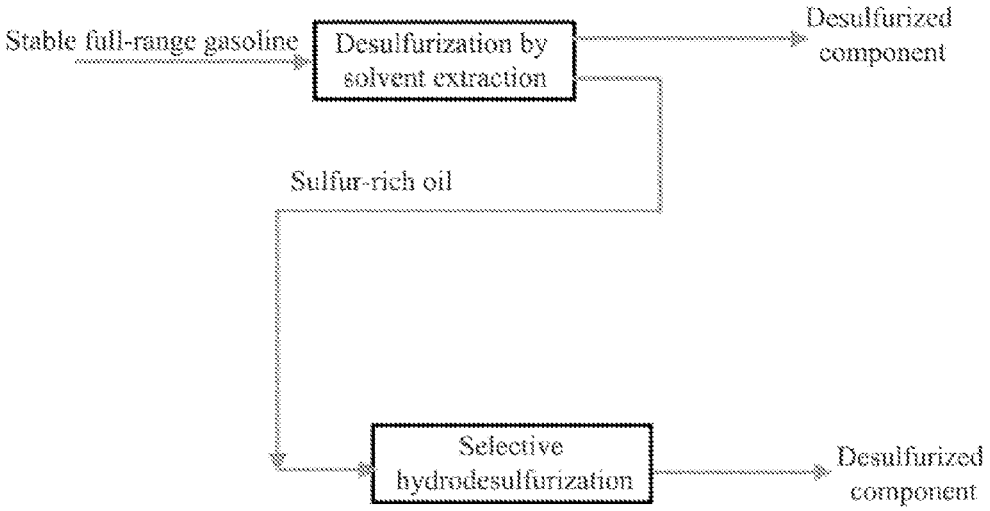

FIG. 7 is a process flow chart of a process for deeply desulfurizing catalytic cracking gasoline according to Embodiment 8 of the present invention.

DETAILED DESCRIPTION

The process for desulfurizing gasoline fractions by solvent extraction according to the present invention, as shown in FIG. 1, includes steps of: introducing a gasoline fraction into an extraction tower 1 from the lower middle part thereof, introducing a solvent into the extraction tower 1 from the top thereof, at the same time injecting pentane into a reflux device at the bottom of the extraction tower 1, where the temperature at the top of the extraction tower is controlled between 55~100° C., the temperature at the bottom of the extraction tower is controlled between 40~80° C., and the pressure (absolute) at the top of the extraction tower is controlled between 0.2~0.7 MPa, a feeding ratio of the solvent to the gasoline fraction is controlled between 1.0~5.0, and a feeding ratio of the pentane to the gasoline fraction is controlled between 0.1~0.5, and where the gasoline fraction and the solvent are contacted at the upper section of the extraction tower 1 via a multi-stage countercurrent, meanwhile the pentane and the solvent are contacted fully at the lower section of the extraction tower 1, the gasoline fraction after being desulfurized by extraction flows out from the top of the extraction tower 1 as a material A, and a mixture of sulfur-containing solvent and pentane flows out from the bottom of the extraction tower 1 as a material B; the material A is introduced into a washing tower 2 and is washed to remove the solvent, obtaining a desulfurized gasoline fraction. The material B is a rich solvent with dissolved sulfide and C5 hydrocarbon-containing light component, which enters into an extraction distillation tower 3 at the top thereof after undergoing heat-exchange with a lean solvent, to conduct extraction and distillation, after that, a light fraction with a relatively low boiling point distilled out from the top of the extraction distillation tower is condensed, and then returned to the reflux device at the bottom of the extraction tower 1 after separating water there from via a reflux accumulator 7; a rich solvent with concentrated sulfur content comes out of the bottom of the extraction distillation tower 3 to be transported to the middle part of a recycling tower 4, in which sulfur-rich oil (including sulfide, aromatics, cycloolefin, etc.) is separated from the solvent via reduced pressure stripping distillation, the distillate from the top of the recycling tower 4 is condensed and then enters a sulfur-rich oil tank 5 to realize water oil separation, a part of the water separated by the sulfur-rich oil tank 5 is returned into the top of the recycling tower 4 as a backflow, and the rest is transported into the washing tower 2 as washing water; the sulfur-rich component separated by the sulfur-rich oil tank 5 may be subjected to selective hydrodesulfurization together with heavy gasoline, or be subjected to further extraction and distillation to recover thiophene and methylthiophene; most of the lean solvent flowing out from the bottom of the recycling tower 4 serves as a heat source of a reboiler at the bottom of a water fractionation tower 6 firstly, and then is returned to the top of the extraction tower 1 to complete solvent circulation after heat-exchange with the rich solvent from the bottom of the extraction tower 1; the water coming out from the bottom of the washing tower 2 and the water separated by the reflux accumulator 7 are merged into the water fractionation tower 6 at the top thereof, trace organics contained in the water are stripped out to return to the reflux accumulator 7, solvent-containing water at the bottom of the water fractionation tower 6 is transported to the bottom of the recycling tower 4 to recover the solvent; a small portion of the lean solvent out from the bottom of the recycling tower 4 is directly transported to the middle part of a solvent regeneration tower 8, vapors generated at the bottom of the water fractionation tower 6 enter the bottom of the solvent regeneration tower 8, in which the lean solvent is subjected to vacuum steam distillation, solvent vapor and water vapor coming from the top of the solvent regeneration tower 8 enter the bottom of the recycling tower 4. The solvent regeneration tower 8 is subjected to irregular slag discharge from its bottom, to remove solvent degradation products, and thus ensuring service performance of system circulating solvent.

In addition to receiving simple saturated C5 hydrocarbon and various backflows involved in the above process, the reflux device at the bottom of the extraction tower 1 may also receive a saturated C5 fraction from the top of a reformed prefractionation tower in the prior art or light fractions of catalytic gasoline as backflows of the extraction tower 1.

Embodiment 1

According to the method and procedures above, a desulfurized product is obtained using a gasoline fraction with a boiling range of 40~100° C. and sulfur content of 200-400 ppm as a raw material according to process conditions as shown in table 1 below. Yield of the desulfurized product is higher than 95% m (mass), and the sulfur content of desulfurized products is lower than 5 ppm.

TABLE 1

| Item | Range |
|---|---|
| Temperature at the top of the extraction tower, ° C. | 65~70 |
| Temperature at the bottom of the extraction tower, ° C. | 50~55 |
| Pressure (absolute) at the top of the extraction tower, MPa | 0.5~0.6 |
| Solvent ratio (relative to feeding) | 2.0~2.5 |
| Reflux ratio (relative to feeding) | 0.2~0.25 |
| Water content of lean solvent, % | 0.6~0.65 |
| Pressure (absolute) of the extraction distillation tower, MPa | 0.2 |
| Temperature at the bottom of the extraction distillation tower, ° C. | 160 |
| Pressure (absolute) of the recycling tower, MPa | 0.035~0.040 |
| Temperature at the bottom of the recycling tower, ° C. | 165~170 |
| Washing water content (relative to product), % | 2~3 |

Embodiment 2

According to the method and procedures above, a desulfurized product is obtained using a gasoline fraction with a boiling range of 40~100° C. and sulfur content of 600-800 ppm as a raw material according to process conditions as shown in table 2 below. Yield of the desulfurized product is higher than 95% m, and the sulfur content of the desulfurized products is lower than 10 ppm.

TABLE 2

| Item | Range |
|---|---|
| Temperature at the top of the extraction tower, ° C. | 80~100 |
| Temperature at the bottom of the extraction tower, ° C. | 60~80 |
| Pressure (absolute) at the top of the extraction tower, MPa | 0.2~0.5 |
| Solvent ratio (relative to feeding) | 1.0~2.0 |
| Reflux ratio (relative to feeding) | 0.3~0.5 |
| Water content of lean solvent, % | 0.8~0.9 |
| Pressure (absolute) of the extraction distillation tower, MPa | 0.2 |
| Temperature at the bottom of the extraction distillation tower, ° C. | 180 |
| Pressure (absolute) of the recycling tower MPa | 0.015~0.35 |
| Temperature at the bottom of the recycling tower, ° C. | 130~160 |
| Washing water content (relative to a product), % | 4.0~10.0 |

Embodiment 3

A universal process for deeply desulfurizing catalytic cracking gasoline, its process flow is shown in FIG. 2, in particular includes steps of:

1) separating the catalytic cracking gasoline into a light gasoline fraction, a medium gasoline fraction and a heavy gasoline fraction, where the cutting point between the light gasoline fraction and the medium gasoline fraction is 40° C., and the cutting point between the medium gasoline fraction and the heavy gasoline fraction is 100° C.;

2) removing mercaptan from the light gasoline fraction obtained from step 1), using a process such as that described in ZL200910250279.8 for removing mercaptan sulfur from a C5 fraction by extracting the mercaptan sulfur into a pure alkali liquor, to obtain a desulfurized light fraction having a sulfur content of less than 10 ppm and a sulfur-rich component H; generally the yield of the desulfurized light gasoline may reach 20~30%(mass) of total amount of full-range gasoline;

3) treating the medium gasoline fraction obtained from step 1) according to the desulfurizing process by solvent extraction as described in Embodiment 1, where the desulfurized light fraction obtained from step 2) enters the reflux device of the extraction tower 1 as described in Embodiment 1 as a backflow, and enters into the extraction tower together with the medium gasoline fraction for treatment, and finally obtaining a desulfurized fraction having a sulfur content of less than 5 ppm and a sulfur-rich component G; and 4) conducting a desulfurization treatment on the heavy gasoline fraction obtained from step 1), together with the sulfur-rich component H obtained from step 2) and the sulfur-rich component G obtained from step 3), all of which have low olefin content and high sulfur content, by using a universal selective hydrodesulfurization technology, such as S-zorb, RSDS, OCT-M, Prime-G+, CODS, etc., to obtain a desulfurized heavy fraction having a sulfur content of less than 10 ppm.

Embodiment 4

A process for deeply desulfurizing catalytic cracking gasoline, its process flow is shown in FIG. 3, in particular includes steps of:

1) treating the catalytic cracking gasoline by an alkali-free sweetening or Prime-G+ prehydrogenation process, to convert micromolecular mercaptan therein into macromolecular sulfide with a high boiling point;

2) separating the catalytic cracking gasoline treated in step 1) into a light gasoline fraction, a medium gasoline fraction and a heavy gasoline fraction, where the cutting point between the light gasoline fraction and the medium gasoline fraction is 36° C., and the cutting point between the medium gasoline fraction and the heavy gasoline fraction is 100° C.;

3) treating the medium gasoline fraction obtained from step 2) according to the desulfurizing process by solvent extraction as described in Embodiment 1, to obtain a desulfurized medium fraction having a sulfur content of less than 5 ppm and a sulfur-rich component G; and 4) conducting a desulfurization treatment on the heavy gasoline fraction obtained from step 2) together with the sulfur-rich component G obtained from step 3), all of which have a low olefin content and a high sulfur content, by using a universal selective hydrodesulfurization technology, such as S-zorb, RSDS, OCT-M, Prime-G+, CODS, etc., to obtain a desulfurized heavy fraction having a sulfur content of less than 10 ppm.

This process is particularly suitable to such a company that has already had a light fraction mercaptan conversion technology (such as Prime-G+ or alkali-free sweetening).

Embodiment 5

A process for deeply desulfurizing catalytic cracking gasoline, its process flow is shown in FIG. 4, in particular includes steps of:

i) separating the catalytic cracking gasoline into a light gasoline fraction I and a heavy gasoline fraction I at a cutting point of 35~70° C.;

ii) treating the light gasoline fraction I obtained from step i) according to the process for desulfurizing gasoline fractions by solvent extraction as described in Embodiment 1, to obtain a desulfurized light fraction I having a sulfur content of less than 10 ppm and a sulfur-rich component J; and iii) conducting a desulfurization treatment on the heavy gasoline fraction I obtained from step i) together with the sulfur-rich component J obtained from step ii) by using an S-zorb selective hydrodesulfurization process, to obtain a desulfurized heavy fraction I having a sulfur content of less than 10 ppm.

This process is particularly suitable to such a company that has already had the S-zorb desulfurization technology.

Embodiment 6

A process for deeply desulfurizing catalytic cracking gasoline, its process flow is shown in FIG. 5, in particular includes steps of:

i) separating the catalytic cracking gasoline into a light gasoline fraction I and a heavy gasoline fractions I at a cutting point of 70~120° C.;

ii) conducting a removing mercaptan treatment on the light gasoline fraction I obtained from step i) by using a conventional extraction oxidation method firstly, and then finely separating the treated light gasoline fraction I' into a light gasoline fraction II and a medium gasoline fraction I at a cutting point of 35~50° C.;

iii) treating the medium gasoline fraction I separated in step ii) according to the process for desulfurizing gasoline fractions by solvent extraction as described in Embodiment 1, to obtain a desulfurized medium fraction I having a sulfur content of less than 10 ppm and a sulfur-rich component K; and iv) conducting a desulfurization treatment on the heavy gasoline fraction I obtained from step i) together with the sulfur-rich component K obtained from step iii) by using an S-zorb selective hydrodesulfurization process, to obtain a desulfurized heavy fraction I having a sulfur content of less than 10 ppm.

This process is particularly suitable to such a company that has already had the RSDS desulfurization technology.

Embodiment 7

A process for deeply desulfurizing catalytic cracking gasoline, its process flow is shown in FIG. 6, in particular includes steps of:

i) separating the catalytic cracking gasoline into a light gasoline fraction I and a heavy gasoline fraction I at a cutting point of 70~90° C.;

ii) conducting a removing mercaptan treatment on the light gasoline fraction I obtained from step i) by using the method recorded in ZL200910250279.8 firstly, to obtain a light gasoline fraction I' and a sulfur-rich component L, and then treating the light gasoline fraction I' according to the process for desulfurizing gasoline fractions by solvent extraction as described in Embodiment 1, to obtain a desulfurized light fractions II having a sulfur content of less than 10 ppm and a sulfur-rich component M; and iii) conducting a desulfurization treatment on the heavy gasoline fraction I obtained from step i) together with the sulfur-rich component L and the sulfur-rich component M obtained from step ii) by using an S-zorb selective hydrodesulfurization process, to obtain a desulfurized heavy fraction I having a sulfur content of less than 10 ppm.

This process is particularly suitable to a company that has already had the stable light and heavy fractions separating technology.

Embodiment 8

A process available for deeply desulfurizing a full-range catalytic cracking gasoline, its process flow is shown in FIG. 7, in particular includes steps of:

I) treating the full-range catalytic cracking gasoline according to the desulfurization process by solvent extraction as described in Embodiment 1, to obtain a desulfurized component and a sulfur-rich component N; and II) conducting a selective hydrodesulfurization treatment on the sulfur-rich component N obtained from step I), to obtain a desulfurized component having a sulfur content of less than 10 ppm.

What is claimed is:

1. A process for desulfurizing a catalytic cracking gasoline fraction by solvent extraction, comprising steps of:

introducing the gasoline fraction into an extraction tower at an about middle part thereof, introducing a solvent into the extraction tower at the top thereof, and injecting saturated C5 hydrocarbon into a reflux device at the bottom of the extraction tower, wherein the temperature at the top of the extraction tower is controlled between 65~80° C., the temperature at the bottom of the extraction tower is controlled between 50~60° C., and the pressure (absolute) at the top of the extraction tower is controlled between 0.5~0.6 MPa, a feeding ratio by volume of the solvent to the gasoline fraction is controlled between 2.0~3.0, and a feeding ratio by volume of the saturated C5 hydrocarbon to the gasoline fraction is controlled between 0.2~0.3, and wherein the gasoline fraction and the solvent are contacted at an upper section of the extraction tower via a multi-stage countercurrent, meanwhile the saturated C5 hydrocarbon and the solvent are contacted at a lower section of the extraction tower, the gasoline fraction which is desulfurized by extraction flows out from the top of the extraction tower, as a material A, and the solvent that has extracted sulfide, aromatics and the C5 hydrocarbon flows out from the bottom of the extraction tower, as a material B; washing the material A for removing solvent therein, to obtain a desulfurized gasoline fraction; further treating the material B to separate a C5 hydrocarbon-containing light component, a sulfur-rich component, water and the solvent, wherein the C5 hydrocarbon-containing light component contains the saturated C5 hydrocarbon and a C5 olefin, wherein the further treating the material B specifically comprises steps of:

① introducing the material B into an extraction distillation tower at the top thereof, wherein the pressure (absolute) of the extraction distillation tower is controlled between 0.15~0.3 MPa, and the temperature at the bottom of the extraction distillation tower is controlled between 150~180° C., the C5 hydrocarbon-containing light component is distilled out as material C from the top of the extraction distillation tower, and a sulfur-rich solvent is obtained as material D at the bottom of the extraction distillation tower;

② after being condensed, returning the material C obtained in step ① to the reflux device at the bottom of the extraction tower; introducing the material D into a recycling tower from a middle part thereof, wherein the pressure (absolute) of the recycling tower is controlled between 0.015~0.05 MPa, and the temperature at the bottom of the recycling tower is controlled between 130~180° C.; a material E, i.e, a sulfur-rich oil containing sulfide, aromatics and cycloolefin, is obtained at the top of the recycling tower; a material F that mainly contains solvent is obtained at the bottom of the recycling tower; and ③ after being condensed, conducting a water oil separation on the material E obtained in step ②, to obtain water and a sulfur-rich component G; returning a portion of the water to the top of the recycling tower in step ②, and returning the rest as washing water to the step of washing the material A for removing solvent; returning the material F obtained in step ②, after heat-exchange, to the top of the extraction tower for recycling;

wherein the solvent is a mixed solvent containing one or two of diethylene glycol, triethylene glycol, tetraethylene glycol, dimethyl sulfoxide, sulfolane, N-formyl morpholine, N-methyl pyrrolidone, polyethylene glycol, and propylene carbonate; and the water content of the solvent is 0.6~0.8% by weight.

2. The process for desulfurizing a gasoline fraction by solvent extraction according to claim 1, wherein the gasoline fraction is a light gasoline fraction with a boiling point of less than 130° C.

3. The process for desulfurizing a gasoline fraction by solvent extraction according to claim 1, wherein the water for washing the material A accounts for 1.0~10.0% by weight of the material A.

4. The process for desulfurizing a gasoline fraction by solvent extraction according to claim 1, wherein: in step ①, the pressure of the extraction distillation tower is controlled at 0.2 MPa, and the temperature at the bottom of the extraction distillation tower is controlled at 160° C.; in step ②, the pressure of the recycling tower is controlled between 0.035~0.045 MPa, and the temperature at the bottom of the recycling tower is controlled between 165~175° C.

5. A process for deeply desulfurizing catalytic cracking gasoline, comprising steps of:

1) separating the catalytic cracking gasoline into a light gasoline fraction, a medium gasoline fraction and a heavy gasoline fraction, wherein the cutting point between the light gasoline fraction and the medium gasoline fraction is 35~50° C., the cutting point between the medium gasoline fraction and the heavy gasoline fractions 70~130° C.;

2) conducting a mercaptan removal treatment on the light gasoline fraction obtained in step 1), to obtain a desulfurized light fraction having a sulfur content of less than 10 ppm and a sulfur-rich component H;

3) treating the medium gasoline fraction obtained in step 1) according to the process for desulfurizing a gasoline fraction by solvent extraction as claimed in claim 1, to obtain a desulfurized medium fraction having a sulfur content of less than 10 ppm and a sulfur-rich component G; and 4) conducting a desulfurization treatment on the heavy gasoline fraction obtained in step 1), together with the sulfur-rich component H obtained in step 2) and the sulfur-rich component G obtained in step 3) by using a selective hydrodesulfurization process, to obtain a desulfurized heavy fraction having a sulfur content of less than 10 ppm.

6. The process for deeply desulfurizing catalytic cracking gasoline according to claim 5, wherein: before separating catalytic cracking gasoline in step 1), micromolecular mercaptan in the catalytic cracking gasoline is converted into macromolecular sulfide with a high boiling point via an alkali-free sweetening or prehydrogenation process.

7. The process for deeply desulfurizing catalytic cracking gasoline according to claim 5, wherein: the light gasoline fraction obtained in step 2) is introduced into the reflux device of the extraction tower used in the extraction desulfurization process in step 3).

8. A process for deeply desulfurizing catalytic cracking gasoline, comprising steps of:

i) separating the catalytic cracking gasoline into a light gasoline fraction I and a heavy gasoline fraction I at a cutting point of 50~130° C.;

ii) treating the light gasoline fraction I obtained in step i) according to the process for desulfurizing a gasoline fraction by solvent extraction in claim 1, to obtain a desulfurized light fraction I having a sulfur content of less than 10 ppm and a sulfur-rich component J; and iii) conducting a desulfurization treatment on the heavy gasoline fraction I obtained in step i) together with the sulfur-rich component J obtained in step ii) by using a selective hydrodesulfurization process, to obtain a desulfurized heavy fraction I having a sulfur content of less than 10 ppm.

9. The process for deeply desulfurizing catalytic cracking gasoline according to claim 8, wherein: in step ii), the light gasoline fraction I obtained in step i) is subjected to a mercaptan removal treatment firstly, and then the resulting mercaptan-removed light gasoline fraction I' is finely cut into a light gasoline fraction II and a medium gasoline fraction I at a cutting point of 35~50° C., and then the medium gasoline fraction I is subjected to the desulfurizing treatment according to the process for desulfurizing a gasoline fraction by solvent extraction in claim 1 to obtain a desulfurized medium fraction I having a sulfur content of less than 10 ppm and a sulfur-rich component K; and the sulfur-rich component K instead of the sulfur-rich component J is introduced into the step iii) to be desulfurized together with the heavy gasoline fraction.

10. The process for deeply desulfurizing catalytic cracking gasoline according to claim 8, wherein: in step ii), the light gasoline fraction I obtained in step i) is subjected to a mercaptan removal treatment by extraction firstly to obtain a mercaptan-removed light gasoline fraction I' and a sulfur-rich component L, and then the mercaptan-removed light gasoline fraction I' is subjected to the desulfurizing treatment according to the process for desulfurizing a gasoline fraction by solvent extraction in claim 1 to obtain a desulfurized light fraction II having a sulfur content of less than 10 ppm and a sulfur-rich component M; and the sulfur-rich component L and the sulfur-rich component M instead of the sulfur-rich component J are introduced into the step iii) to be desulfurized together with the heavy gasoline fraction.

11. The process for desulfurizing a gasoline fraction by solvent extraction according to claim 1, wherein the gasoline fraction is a light gasoline fraction with a boiling range of 40~100° C.

12. The process for desulfurizing a gasoline fraction by solvent extraction according to claim 1, wherein the water for washing the material A accounts for 2~4% by weight of the material A.

* * * * *